US006568462B1

(12) United States Patent
Barteri et al.

(10) Patent No.: US 6,568,462 B1
(45) Date of Patent: May 27, 2003

(54) AUSTENITIC STAINLESS STEEL STRIPS HAVING GOOD WELDABILITY AS CAST

(75) Inventors: Massimo Barteri, Rome (IT); Giorgio Porcu, Rome (IT); Antonio Mascanzoni, Rome (IT)

(73) Assignees: Acciai Speciali Terni S.p.A., Terni TR (IT); Voest-Alpine Industrieanlagenbau GmbH, Linz (AT)

( * ) Notice: Subject to any disclaimer, the term of this patent is extended or adjusted under 35 U.S.C. 154(b) by 0 days.

(21) Appl. No.: 09/463,764

(22) PCT Filed: Jul. 31, 1998

(86) PCT No.: PCT/IT98/00223

§ 371 (c)(1),
(2), (4) Date: Apr. 20, 2000

(87) PCT Pub. No.: WO99/06602

PCT Pub. Date: Feb. 11, 1999

(30) Foreign Application Priority Data

Aug. 1, 1997 (IT) ..... RM97A0488

(51) Int. Cl.[7] ..... B22D 11/06; B22D 11/124
(52) U.S. Cl. ..... 164/480; 164/428; 164/485
(58) Field of Search ..... 164/477, 480, 164/485, 429, 428

(56) References Cited

U.S. PATENT DOCUMENTS 5,030,296 A * 7/1991 Ueda et al. ..... 148/2
5,284,535 A * 2/1994 Ueshima et al. ..... 148/610

FOREIGN PATENT DOCUMENTS

EP 0 434 887 4/1991
EP 0 458 987 12/1991
EP 0 481 481 A1 * 4/1992
EP 0 463 182 7/1995
EP 0 378 705 1/1996

OTHER PUBLICATIONS

Patent Abstracts of Japan, vol. 010, No. 301(M–525), JP 61 115674, Oct. 14, 1986.
Patent Abstracts of Japan, vol. 014, No. 305 (M–0992), JP 02 099295, Jun. 29, 1990.
Database WPI, Sec. Ch, Week 9311, Derwent Publ. Long, GB; AN 93–091518, XPOO2082153, Aug. 10, 1992.
Patent Abstracts of Japan, vol. 018, No. 037, (M–1545), JP 05 269555, Jan. 20, 1994.

* cited by examiner

*Primary Examiner*—Tom Dunn
*Assistant Examiner*—Len Tran
(74) *Attorney, Agent, or Firm*—Browdy and Neimark, P.L.L.C.

(57) ABSTRACT

A process for the production of austenitic stainless steel strips having as case a good weldability, comprising the operations of: solidification in a mold of a continuous casting apparatus with twin counterrotatng rolls, a strip having a thickness comprised between 1 to 5 mm and having the following composition in percent by weight: Cr 17–20; Ni 6–11; c<0.04; n<0.04; s<0.01; Mn<1.5; Si<1.0; Mo 0–3; Al<0.03; and possibly, Ti, Nb, Ta so that: Ti+0.5(Nb+Ta) >6C-3S with proviso that Ti>6S, or NB+Ta>1C with the proviso that TI<6S; being in any case Nb+Ti+Ta<1.0; the remaining part being substantially Fe with a δ-ferrite volume percentage comprised between 4 and 10% calculated with the formula: δ-ferrite=(Creq/Nieq−0.728)×500/3 wherein: Creq/Nieq=[Cr+Mo+1.5Si+)0.5Nb+0.25Ta+2.5(Al+Ti)+18]/[Ni+30(C+N)+0.5Mn+36]; and, possibly, heating the strip at a temperature between 900 to 1200° C. for a period of time less than 5 minutes. Subject of the invention is also the stainless steel strip obtained with the process and the use thereof for manufactured welded products, i.e. welded tubes.

5 Claims, 4 Drawing Sheets

AUSTENITIC STAINLESS STEEL STRIPS HAVING GOOD WELDABILITY AS CAST

CROSS REFERENCE TO RELATED APPLICATION

The present application is the national stage under 35 U.S.C. 371 of PCT/IT98/00223, filed Jul. 31, 1998.

DESCRIPTION

The present invention relates to a process for the production of austenitic stainless steel strips having, as cast, a good weldability, through the solidification thereof in a mould with counterrotating rolls of a continuous casting apparatus. Further, the present invention relates to an austenitic stainless steel strip so obtainable through said process and suitable for the production of welded tubes.

Austenitic stainless steels are known to provide an excellent corrosion and oxidation strength, together with good mechanical properties. In fact, these kinds of steel are often employed in the production of tubes starting from flat products derived from hot-rolling followed possibly by cold-rolling processes.

Generally, thin stainless steel strips are obtained by a conventional process comprising the continuous casting of slabs, followed possibly by a grinding operation, slabs heating to 1000–1200° C., hot-rolling, annealing, possibly followed by cold-rolling, final annealing and pickling.

This process requires a large energy consumption both for the slabs heating and for the material processing.

On the other side, the continuous strip casting process is a recent, still developing technique, shown, for instance, in "Recent developments of Twin-Roll Strip Casting process at AST Terni Steelworks" of the authors R.Tonelli, L.Sartini, R.Capotosti, A.Contaretti; Pro. Of METEC Congress 94 Dusseldorf, Jun. 20–22 1994, by which it allows thin strips to be produced directly as the cast product and thus avoiding the hot-rolling operation.

In order to obtain austenitic stainless steel strips suitable to be used as cast, it is necessary to operate on the primary solidification procedure. In fact, the primary solidification structure is subject to changes from austenite to ferrite (δ-ferrite) depending on the steel chemical composition and on the cooling rate during solidification.

The formation of a suitable quantity of δ-ferrite during the solidification process is crucial to avoid cracks to be formed in the cast strips. The presence of δ-ferrite is also advantageous for the successive weldability of the strips to avoid cracks due to the heating. On the other hand, an excess of δ-ferrite at the welded joints, can involve risks concerning corrosion strength and ductility.

Various control procedures for continuous casting of austenitic stainless steel strips are known in the art. For instance, EP 0378705 B1 discloses a process for the production of stainless steel thin strips aimed at obtaining a good surface quality by controlling the differential cooling rate at a high and low temperature and by controlling the δ-ferrite volume percentage in the resulting cast product.

On the other hand, EP 043182 B1 discloses a process for the production of stainless steel strips having excellent surface qualities based on the main choice of holding the obtained strip at specific temperatures for fixed periods of time.

However, the above processes aim at improving the final product surface quality, and do not teach a method for obtaining a product having excellent weldability.

Therefore, the present invention provides a process for the production of austenitic stainless steel strips, by means of the continuous casting technique in a mould with counterrotating rolls, that it aims at obtaining excellent weldability properties on the strips as cast.

Another object of the present invention is to provide austenitic stainless steel strips, obtained with the above process, and having excellent weldability properties as cast and being suitable to be used in the production of welded tubes.

Thus, subject of the present invention is a process for the production of austenitic stainless steel strips having, as cast, good weldability, comprising the casting operation in a mould with twin counterrotating rolls of a continuous casting apparatus, of a strip having thickness comprised between 1 to 5 mm, and having the following composition in percent by weight:

Cr 17–20; Ni 6–11; C<0.04; N<0.04; S<0.01; Mn<1.5; Si<1.0; Mo 0–3; Al<0.03; and wherein Ti, Nb, Ta are provided in the strip so that:

Ti+0.5(Nb+Ta)>6C-3S with the proviso that Ti>6S; or Nb+Ta>12C with the proviso that Ti<6S;

being, in every case, Nb+Ti+Ta<1.0%; the remaining part being Fe and impurities, and having a dendritic solidification microstructure with an average grain size, measured on a cross-section parallel to the strip surface, comprised between 30 and 80 μm, and having a δ-ferrite volume percentage comprised between 4 and 10%, calculated by the formula:

$$\delta\text{-ferrite}=(Creq/Nieq-0.728)\times 500/3$$

wherein:

$$Creq/Nieq=[Cr+Mo+1.5Si+0.5Nb+0.25Ta+2.5(Al+Ti)+18]/[Ni+30(C+N)+0.5Mn+36];$$

wherein the element symbols represent their weight percentage in the whole composition.

Further, according to the present invention, the process provides possibly the heating of the strip to a temperature comprised in the range from 900 and 1200° C. for a period of time less than 5 minutes.

Furthermore, subject of the present invention is an austenitic stainless steel strip obtainable with the abovementioned process and suitable to be used in the production of welded tubes.

AccordIng to the invention, the austenitic stainless average grain size in the range from 30 to 80 μm.

Further, the absence of central segregation of elements such as C, Cr, Ni, confers to the material homogeneity of properties together with the moderate grain size, being very important for both molding and welding operations.

The strip as cast shows a much lower residual strain-hardening ratio compared to that of a strip hot-rolled by a common work cycle and therefore does not require any stress relieving heat treatments before being used in molding operations.

The present invention has the further advantage that the resulting strips provide a suitable material to be welded for the manufacture of welded tubes not requiring final thermal treatments.

Another advantage of the present invention lies in that the resulting austenitic stainless steel strip, possibly when con taining elements such as Ta, Ti, Nb, shows no grain edge dechromizing effect due to chromium carbide precipitation, therefore providing an improvement in corrosion strength and ductility of the welded portion.

DETAILED DESCRIPTION OF THE PREFERRED EMBODIMENT

The present invention will be better illustrated herebelow by means of a detailed description of an embodiment thereof, given as a non limiting example, with reference to the accompanying drawings, wherein.

Figure 3:
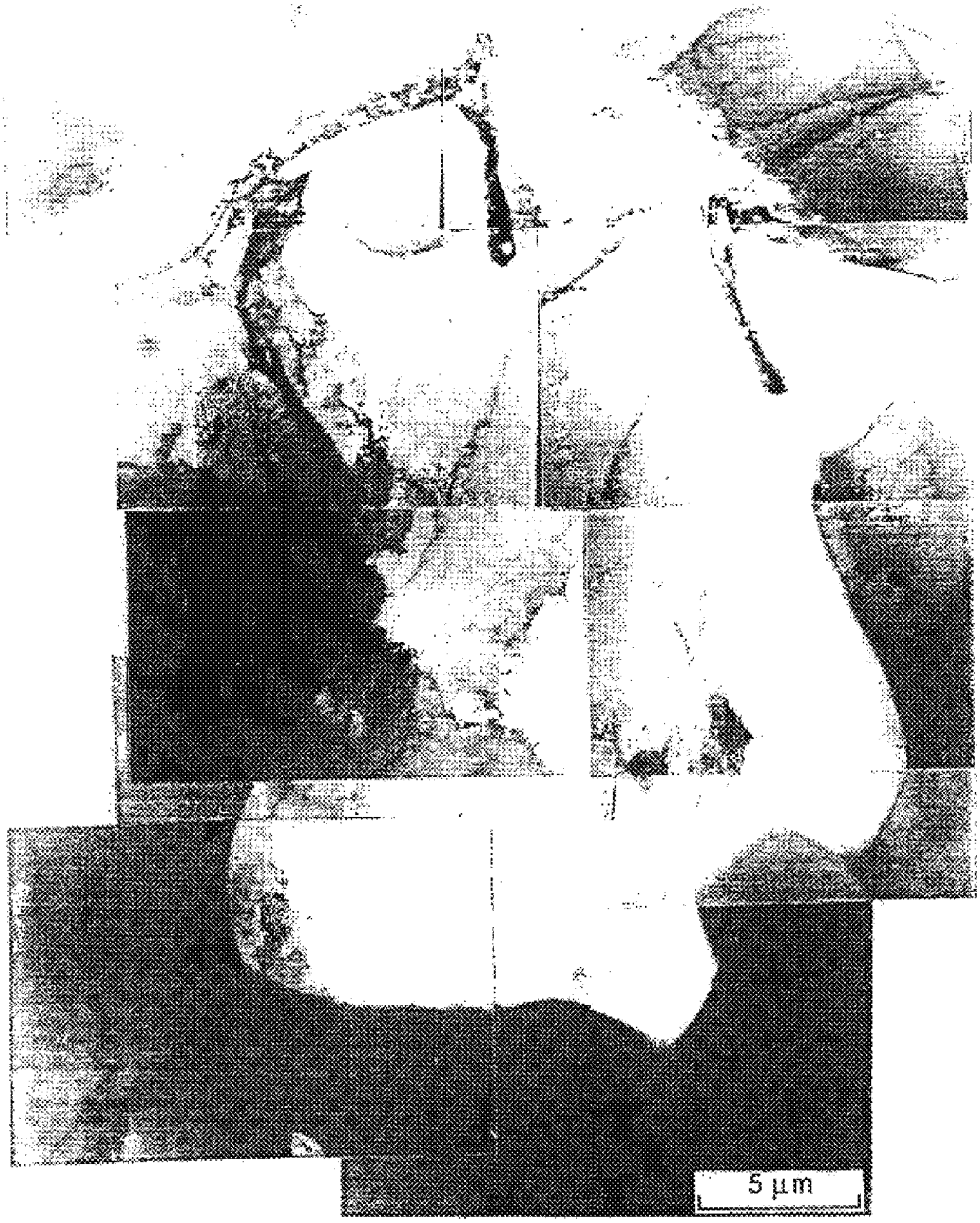
Figure 4:
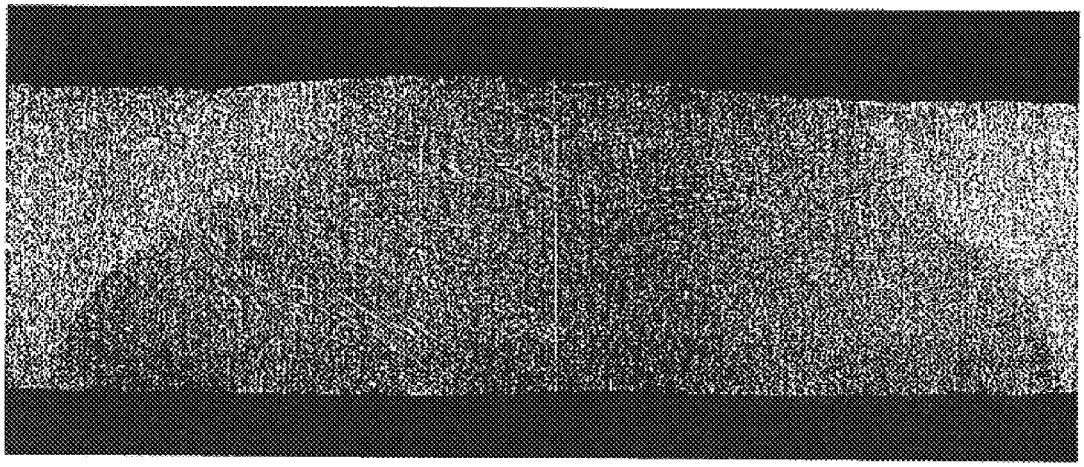

FIG. 3 shows a microphotography taken with a transmission electronic microscope displaying morphology and typical grain size of the solidification structure of an austenitic stainless steel strip obtained with the process of the present invention; and FIG. 4 shows a microphotography taken with an optical microscope which represents the microstructure. of a joint welded by "TIG" procedure, accomplished on a austenitic stainless steel strip according to the present invention.

Figure 1:
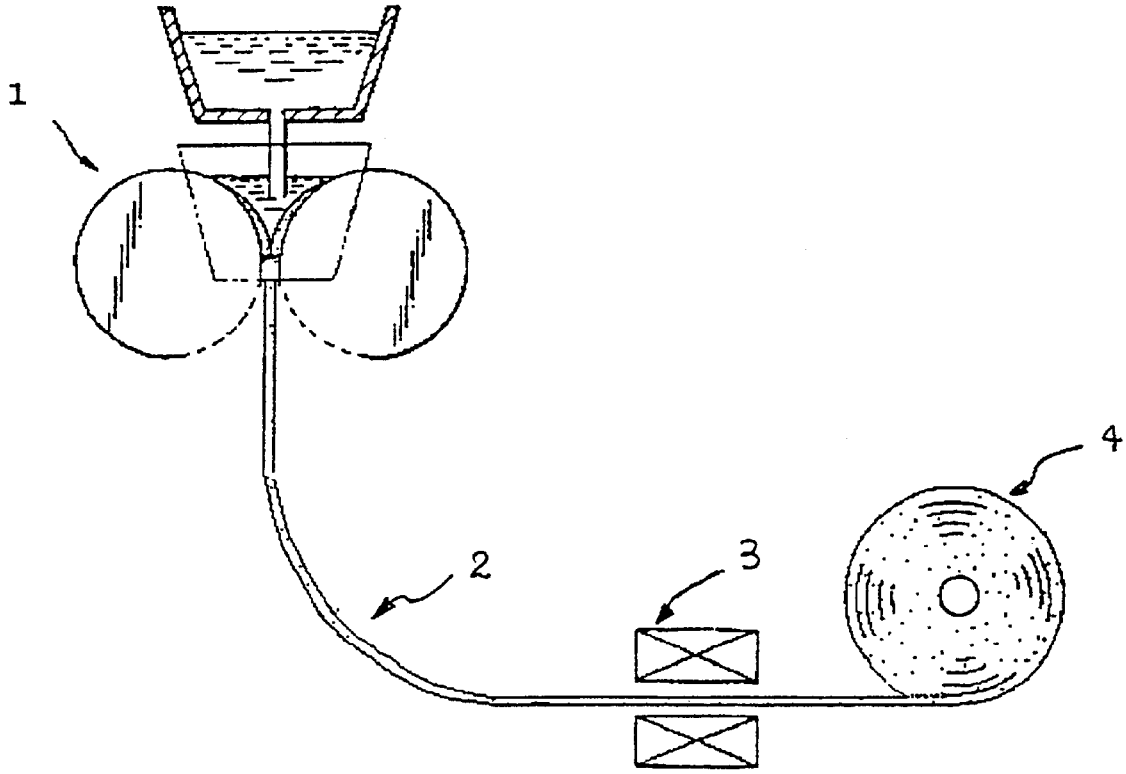
FIG. 1 shows a simplified scheme of the thin strips continuous casting apparatus with twin counterrotating rolls, according to the present invention.

Referring now to FIG. 1, according to the present invention, a continuous casting machine having twin counterrotating rolls 1, downstream from which a thin strip 2 comes out, is required to carry out the process of the present invention. Further, a controlled cooling station 3 and a winding reel 4 are subsequently provided.

Series of experimental castings of thin strips having a thickness comprised in the range from 2.0 to 2.5 mm were carried out, by using the process of the present invention.

All the test strips so obtained showed good mechanical and microstructural properties. The chemical composition of test strips was defined in the following ranges:

Cr=17–20%; Ni=6–11%; Al<0.03%; C<0.04%; N<0.04%; S<0.01%; Mn<1.5%; Si<1.0%, Mo 0–3%. The calculated δ-ferrite volume fraction was in the range of 3–11%.

The mechanical properties of a cast strip obtained with the process of the present invention are:

$Rp_{0.2\%}$=230 MPa (Unitary Yield Point)

Rm=520 MPa (Unitary Fracture Stress)

A=50% (Elongation at Fracture stress)

The welding performances were evaluated by carrying out a series of weldability procedures and trials, relating them to chemical composition and δ-ferrite content. The strips having a δ-ferrite volume ratio less than 4% shown the tendency to heat crack and their welded joints did not resist to bending tests. On the other side, a content of δ-ferrite above 10% was found enough to cause a poor localized strength corrosion, particularly a pitting corrosion strength.

This effect is due to the different chromium content between ferrite and austenite, resulting in a reduction of chromium in the γ phase. For these reasons, the chemical composition of these kinds of steels has to be strictly checked.

Further, the annealing treatment carried out on the cast strips was found to be advantageous to bring the δ-ferrite content back within the desired range when, owing to a chemical composition control lack, it was above the maximum desired value. In fact, the δ-ferrite content was found to decrease with the increasing of time and annealing temperature.

Further, addition of elements such as titanium, niobium and tantalum, forming high stability carbides, was found to be very effective for inhibiting the intergranular chromium carbides formation, thus avoiding the chromium impoverishment at the thermally altered portion of the welded joint. An improvement in the intergranular corrosion strength is obtained as an effect of this result.

Besides, the addition of elements such as titanium, niobium, tantalum, through formation of their carbides, inhibits the grain size growth, inducing a higher ductility in the thermally altered portion of the welded joint.

Figure 2:
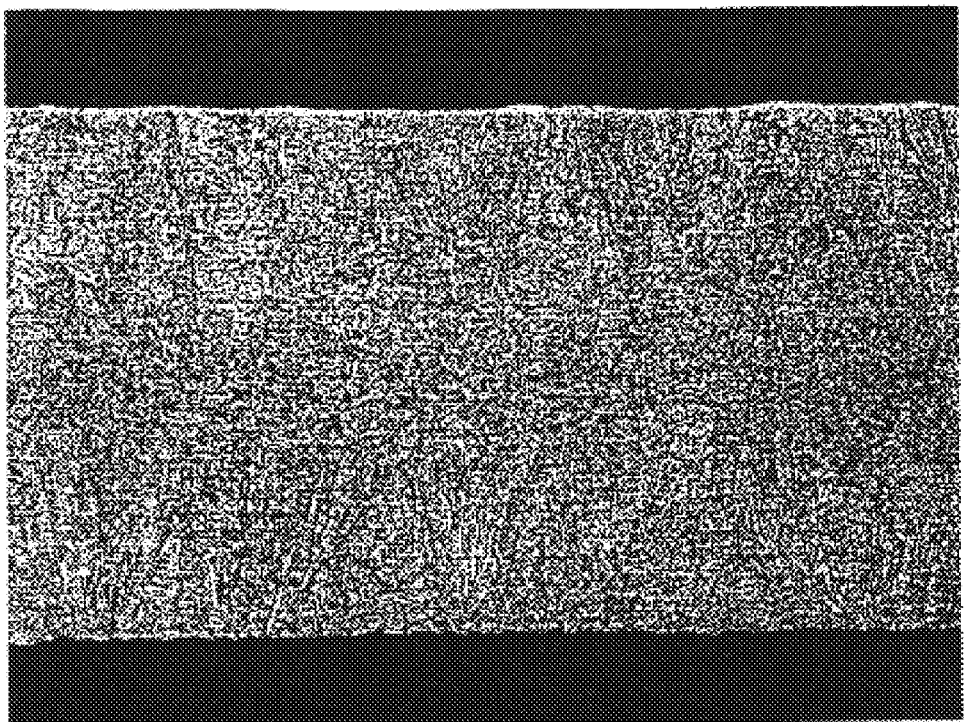
FIG. 2 shows a microphotography taken with an optical microscope of the microstructure of a stainless steel strip obtained according to the present invention.

In the following, by way of non limiting examples, comparative and explanatory examples of experimental tests performed both with strips produced by the process of the present invention and with strips produced with usual techniques, will be illustrated, referring to FIGS. 2, 3 e 4 and to the accompanying Tables which, for the sake of simplicity in the description, they are shown at the end of the described examples.

EXAMPLE 1

The strips having composition (a), as shown in Table 1, were produced according to the process of the present invention.

The liquid steel was cast in a vertical continuous casting machine having its mould with twin counterrotating rolls to form cast strips having a thickness of 2 mm. The strip was immediately cooled at the outlet at a rate of 25° C./s, and subsequently winded on a winding reel at a temperature of 950° C. The calculated δ-ferrite volume fraction was about 6.4%.

Then, the strip was pickled, shaped and welded by means of "TIG" welding, to form round sectioned tubes with a 100 mm diameter and 30×30 mm square section. The welding process was performed using the following process parameters:

welding current 130 A;

torch advancement rate 28 and 34 cm/min;

protection gas argon (flow 7 l/min).

The welded joint microstructure is shown in FIG. 4. The δ-ferrite volume ratio at the welded joint was measured to be 6.0%. The weldline breaking strength was determined by means of tensile and bend tests, the welding integrity was determined by ultrasonic analysis. The results of the tensile tests carried out on the welded joints obtained from the strips of chemical composition (a) are shown in Table 2.

At the test conclusion, neither defects nor cracks were found at the welded portions. Intergranular corrosion tests were also performed, according to specification ASTM A262 condition C (Huey test) involving 5 exposure cycles to hot $HNO_3$ of 48 hours each. The corrosion rates of two samples of the same strip are shown in Table 3, their value (about 0.35 mm/year) being consistent with the expected applications and comparable with that of products obtained by traditional techniques.

EXAMPLE 2

Another strip was obtained with the process of the present invention, but with a different chemical composition (referring to "b" in Table 1). The calculated δ-ferrite content was 2.9%.

30×30 mm welded square tubes were obtained from this strip.

Welded tubes ultrasonic analysis produced evidence of cracks at the welded joints and flaws appeared after the bending tests.

EXAMPLE 3

A strip with composition "c" according to Table 1, was obtained with the process of the present invention. The calculated δ-ferrite content was 11.1%. Therefore, the strip was considered not suitable as the performances requested according to the present invention.

The strip was then annealed at 1100° C. for 5 min.

After this treatment, the δ-ferrite content measured in the strip was 7%. Then, the strip was pickled, shaped and welded by TIG welding, to form round sectioned tubes with a 100 mm diameter and 30×30 mm square section tubes.

The welding process was performed using the following process parameters:

welding current 132 A;

torch advancement rate 28 and 34 cm/min;

protection gas argon (flow 7 l/min).

Subsequently, tensile and bending tests were performed on welded joints obtained from said strip; the welding integrity was determined by ultrasonic analysis. The mechanical characteristics of the welded joints obtained from the steel of composition (c) are shown in Table 2.

Neither defects nor cracks were found at the welded portions. Intergranular corrosion strength tests performed in the same conditions as the Example 1 provided average corrosion rate values of 0.4 mm/year (see Table 3), comparable to those of the "a" steel composition.

What is claimed is:

1. Process for the production of austenitic stainless steel strips, comprising casting in a mould with twin counterrotating rolls of a continuous casting apparatus, a strip having thickness between 1 to 5 mm, and consisting of the following composition in percent by weight:

Cr 17–20; Ni 6–11; C<0.04; N<0.04; S<0.01; Mn<1.5; Si<1.0; Mo 0–3; Al<0.03; and wherein Ti, Nb, Ta are provided in the strip so that:

Ti+0.5(Nb+Ta)>6C-3S when Ti>6S; and

Nb+Ta>12C when Ti<6S;

wherein, in either case, Nb+Ti+Ta<1.0%;

the remaining part being Fe and impurities, and having a dendritic solidification microstructure with an average grain size, measured on a cross-section parallel to the strip surface, between 30 and 80 μm, and having a δ-ferrite volume percentage between 4 and 10%, calculated by the formula:

$$\delta\text{-ferrite}=(Creq/Nieq-0.728)\times 500/3$$

wherein:

$$Creq/Nieq=[Cr+Mo+1.5Si+0.5Nb+0.25Ta+2.5(Al+Ti)+18]/[Ni+30(C+N)+0.5Mn+36];$$

wherein the element symbols represent their weight percentage in the whole composition; and cooling the resultant stainless steel strip as cast at a cooling rate of 20–50° C./s.

2. Process for the production of austenitic stainless steel strips according to claim 1, wherein subsequent to the casting, the cooled strip, as cast, is heated to a temperature between 1000 and 1200° C. for a period of less than 5 minutes.

3. Austenitic stainless steel strip obtained with the process according to claim 1.

4. In a method for the production of manufactured welded products comprising welding an austenitic stainless steel strip, the improvement wherein said austenitic stainless strip is that in accordance with claim 3.

5. Manufactured welded product obtained by the method of claim 4.

TABLE 1

Chemical composition of the steels used in Examples 1, 2, 3 (weight %)

| Steel | C | Si | Mn | P | S | Ni | Cr | Mo | N | Al | Ti | Nb | δ-ferrite |
|---|---|---|---|---|---|---|---|---|---|---|---|---|---|
| a | 0.040 | 0.36 | 1.47 | 0.027 | 0.001 | 8.06 | 18.04 | 0.28 | 0.050 | 0.003 | 0.005 | 0.005 | 6.4 |
| b | 0.041 | 0.44 | 1.73 | 0.026 | 0.001 | 9.40 | 17.80 | 0.18 | 0.035 | 0.005 | 0.005 | 0.005 | 2.9 |
| c | 0.038 | 0.36 | 1.54 | 0.038 | 0.001 | 7.4 | 18.60 | 0.15 | 0.036 | 0.005 | 0.005 | 0.005 | 11.09 |

TABLE 2

Results of tensile tests carried out on the welded joints of the Examples

| Steel | Thermal Feed (kJ/mm) | Rp0,2 (MPa) | Rm (Mpa) | $A_{60}$ (%) | Fracture Localization |
|---|---|---|---|---|---|
| a | 0.30 | 255 | 534 | 35.6 | Base material |
| | 0.25 | 280 | 580 | 34.4 | Base material |
| c | 0.31 | 307.1 | 666.5 | 31.1 | Base material |
| | 0.27 | 306.3 | 699.4 | 35.2 | Base material |

TABLE 3

Intergranular corrosion tests (ASTM A262-C) carried out on the welded joints of the Examples.

| Steel | Corrosion Rate (mm/year) |
|---|---|
| a | 0.34–0.36 |
| c | 0.43–0.40 |
| Conventional Mat. | 0.40–0.60 |

* * * * *